US010133206B2

(12) United States Patent
Tanaka

(10) Patent No.: US 10,133,206 B2
(45) Date of Patent: Nov. 20, 2018

(54) IMAGE FORMING APPARATUS AND IMAGE FORMING METHOD

(71) Applicant: CANON KABUSHIKI KAISHA, Tokyo (JP)

(72) Inventor: Sumito Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/415,166

(22) Filed: Jan. 25, 2017

(65) Prior Publication Data

US 2017/0227884 A1 Aug. 10, 2017

(30) Foreign Application Priority Data

Feb. 5, 2016 (JP) ..... 2016-020768

(51) Int. Cl.
*G03G 15/06* (2006.01)
*G03G 15/00* (2006.01)

(52) U.S. Cl.
CPC ..... *G03G 15/065* (2013.01); *G03G 15/5041* (2013.01); *G03G 15/556* (2013.01)

(58) Field of Classification Search
CPC ..... G03G 15/0266; G03G 15/1645; G03G 15/0848
See application file for complete search history.

(56) References Cited

U.S. PATENT DOCUMENTS 5,937,229 A * 8/1999 Walgrove ..... G03G 15/1645 399/46
8,335,441 B2 12/2012 Kubo et al.
8,837,965 B2 * 9/2014 Tanaka ..... G03G 15/5037 399/49
9,057,977 B2 * 6/2015 Kubo ..... G03G 15/0266
2005/0141905 A1 * 6/2005 Kin ..... H04N 1/4078 399/27
2008/0205923 A1 * 8/2008 Takeuchi ..... G03G 15/0853 399/62
2011/0164888 A1 * 7/2011 Kubo ..... G03G 15/0266 399/27
2012/0128380 A1 * 5/2012 Hirabayashi ..... G03G 15/0848 399/49
2012/0183315 A1 * 7/2012 Fujiwara ..... G03G 15/5041 399/49
2013/0064560 A1 * 3/2013 Hirabayashi ..... G03G 15/5037 399/44
2013/0071131 A1 * 3/2013 Hirabayashi ..... G03G 15/5041 399/30

(Continued)

FOREIGN PATENT DOCUMENTS

JP 08110664 A * 4/1996
JP 2007147980 A * 6/2007
JP 2008039805 A * 2/2008

*Primary Examiner* — Sevan A Aydin
(74) *Attorney, Agent, or Firm* — Fitzpatrick, Cella, Harper & Scinto

(57) ABSTRACT

Provided is an image forming apparatus, including a photosensitive member, a latent image forming unit configured to form an electrostatic latent image on the photosensitive member, a developing unit configured to store developer containing toner and to develop the electrostatic latent image on the photosensitive member using the developer, a detector configured to detect an amount of the toner stored in the developing unit, and a supplying unit configured to supply toner to the developing unit.

8 Claims, 9 Drawing Sheets

(56) References Cited

U.S. PATENT DOCUMENTS

| | | | | |
|---|---|---|---|---|
| 2014/0255052 | A1* | 9/2014 | Fujiwara | G03G 15/5058 399/49 |
| 2014/0314432 | A1* | 10/2014 | Uchino | G03G 15/0848 399/49 |
| 2014/0314434 | A1* | 10/2014 | Shigemura | G03G 15/0851 399/55 |
| 2015/0037054 | A1* | 2/2015 | Nagata | G03G 15/1665 399/49 |
| 2015/0110509 | A1* | 4/2015 | Yagyu | G03G 15/0848 399/53 |
| 2017/0123361 | A1* | 5/2017 | Zaima | G03G 15/556 |

* cited by examiner

IMAGE FORMING APPARATUS AND IMAGE FORMING METHOD

BACKGROUND OF THE INVENTION

Field of the Invention

The present invention relates to a technology of controlling an image forming condition.

Description of the Related Art

An electrophotographic image forming apparatus is configured to charge toner particles to form an image using an electrostatic force. Therefore, when a charge amount of the toner particles changes, density and quality of an output image may change in accordance with the change. The charge amount of the toner particles significantly changes depending on usage environment, the density of the output image, elapsed time from the output, and other factors. Therefore, the output image may fluctuate depending on various conditions when control to stabilize the output is not performed.

The image forming apparatus is configured to form an image using a developer containing toner particles and carrier particles. This image forming apparatus is configured to limit toner supply based on a result of detecting the amount of toner particles. In this image forming apparatus, the charge amount of the toner particles changes depending on a mixing ratio (T/C ratio) of toner particles to carrier particles in a developing device. That is, when the ratio of the toner particles decreases, the charge amount of the toner particles increases. When the charge amount of the toner particles increases, the amount of toner particles that adhere to a latent image having a certain charge decreases to cause a decrease in image density. In contrast, when the ratio of the toner particles increases, the charge amount of the toner particles decreases. When the charge amount of the toner particles decreases, the amount of toner particles that adhere to a latent image having a certain charge increases to cause increase in image density.

To address this problem, the image forming apparatus is configured to form a measurement image to perform feedback control of controlling the toner supply amount based on the amount of toner adhering to the measurement image, which is measured by a sensor. However, toner supply control causes downtime because image forming conditions are corrected after the amount of toner adhering to the measurement image is measured. Further, there has been a problem in that it takes time to change the charge amount of the toner particles in the developing device after the toner supply.

In view of this, as a technology for solving those problems, there is known a technology of estimating the charge amount of the toner particles, to thereby control the image forming conditions in real time (U.S. Pat. No. 8,335,441).

In the image forming apparatus described in U.S. Pat. No. 8,335,441, a stirring time constant of the toner charge amount and a charge eliminating time constant of the toner charge amount are regarded as constant values.

However, the time constants change depending on the environment in which the image forming apparatus is placed and other factors. When the time constants change, a predicted value of the toner charge amount may be deviated from the actual toner charge amount, and thus the density of the image formed based on the image forming conditions suitable for the predicted value of the toner charge amount may differ from a target density.

SUMMARY OF THE INVENTION

An image forming apparatus according to the present disclosure includes: a photosensitive member; a latent image forming unit configured to form an electrostatic latent image on the photosensitive member; a developing unit configured to store developer containing toner and to develop the electrostatic latent image on the photosensitive member using the developer; a detector configured to detect an amount of the toner stored in the developing unit; a supplying unit configured to supply toner to the developing unit; a determining unit configured to determine, based on a determination condition, a charge amount of the toner in the developing unit depending on an amount of toner consumed in the developing unit, an amount of the toner supplied by the supplying unit, and the amount of the toner detected by the detector; a controller configured to control an image forming condition based on the charge amount determined by the determining unit; a measuring unit configured to measure a measurement image formed by the photosensitive member, the latent image forming unit, and the developing unit; and an updating unit configured to update the determination condition based on a measurement result obtained by the measuring unit.

Further features of the present invention will become apparent from the following description of exemplary embodiments (with reference to the attached drawings).

DESCRIPTION OF THE EMBODIMENTS

Now, as an example of an image forming apparatus to which the present invention is applied, an electrophotographic image forming apparatus is described with reference to the drawings.

Figure 1:
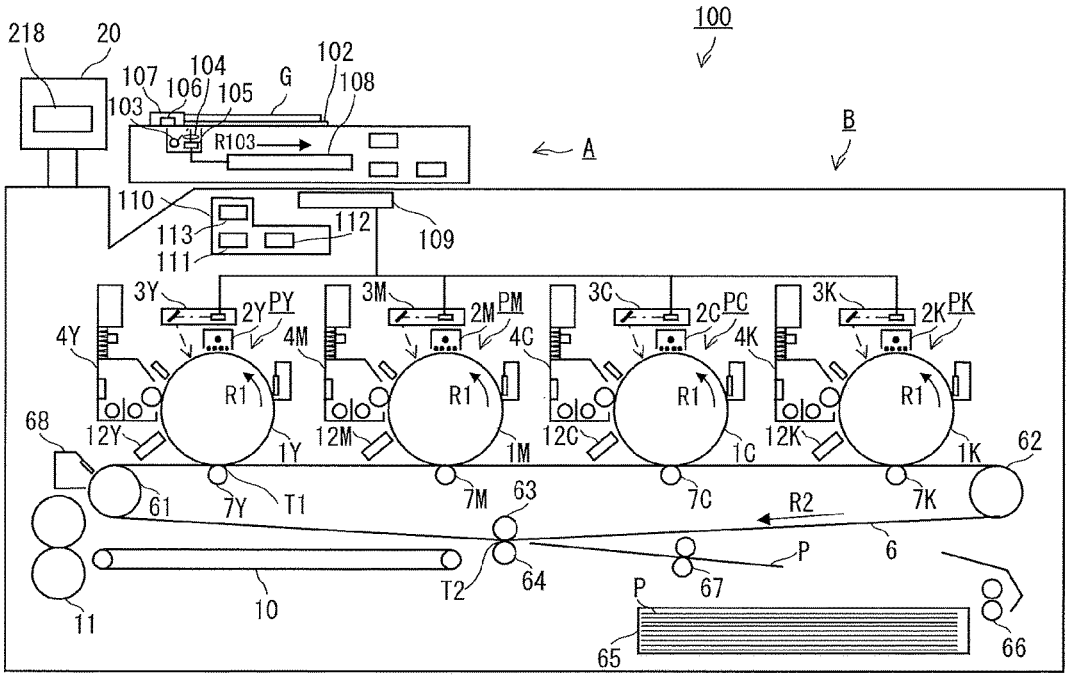
FIG. 1 is a schematic sectional view of an image forming apparatus.

FIG. 1 is a view for illustrating an example of a configuration of an image forming apparatus. An image forming apparatus 100 includes an image reading device A, a printer unit B, and an operation unit 20. As illustrated in FIG. 1, the printer unit B includes image forming portions PY, PM, PC, and PK for yellow, magenta, cyan, and black, which are arranged along an intermediate transfer belt 6.

The image forming portion PY includes a photosensitive drum 1Y being a photosensitive member, a charging device 2Y, an exposure device 3Y, and a developing device 4Y. The image forming portion PY is configured to form a yellow toner image on the photosensitive drum 1Y. A primary transfer roller 7Y is configured to transfer the yellow toner image formed by the image forming portion PY onto the intermediate transfer belt 6.

The image forming portion PM includes a photosensitive drum 1M being a photosensitive member, a charging device 2M, an exposure device 3M, and a developing device 4M. The image forming portion PM is configured to form a magenta toner image on the photosensitive drum 1M. A primary transfer roller 7M is configured to transfer the magenta toner image formed by the image forming portion PM onto the intermediate transfer belt 6.

The image forming portion PC includes a photosensitive drum 1C being a photosensitive member, a charging device 2C, an exposure device 3C, and a developing device 4C. The image forming portion PC is configured to form a cyan toner image on the photosensitive drum 1C. A primary transfer roller 7C is configured to transfer the cyan toner image formed by the image forming portion PC onto the intermediate transfer belt 6.

The image forming portion PK includes a photosensitive drum 1K being a photosensitive member, a charging device 2K, an exposure device 3K, and a developing device 4K. The image forming portion PK is configured to form a black toner image on the photosensitive drum 1K. A primary transfer roller 7K is configured to transfer the black toner image formed by the image forming portion PK onto the intermediate transfer belt 6.

The toner images formed by the image forming portions PY, PM, PC, and PK are transferred onto the intermediate transfer belt 6 in a superimposed manner, and thus the intermediate transfer belt 6 bears a full-color toner image. The intermediate transfer belt 6 functions as an intermediate transfer member onto which the toner images are transferred. The intermediate transfer belt 6 is looped around a tension roller 61, a drive roller 62, and an opposing roller 63. The drive roller 62 is rotationally driven to move the intermediate transfer belt 6 in an R2 direction.

The toner image transferred onto the intermediate transfer belt 6 is conveyed to a secondary transfer portion T2 through movement of the intermediate transfer belt 6 in the R2 direction indicated in FIG. 1. The opposing roller 63 and a secondary transfer roller 64 are configured to transfer the toner image on the intermediate transfer belt 6 onto a recording material P. A conveyance belt 10 is configured to convey the recording material P having the toner image transferred thereon to a fixing device 11. The fixing device 11 includes a roller pair and a heater (not shown). The fixing device 11 is configured to heat the toner image on the recording material P and pressurize the recording material P, to thereby fix the toner image onto the recording material P. The recording material P having the toner image fixed thereon is delivered to the outside of the apparatus.

The recording materials P drawn out from a recording material cassette 65 are separated one by one by separation rollers 66 to be fed to registration rollers 67. The registration rollers 67 are configured to control the timing to feed the recording material P to the secondary transfer portion T2 and the conveyance speed of the recording material P such that the timing at which the toner image on the intermediate transfer belt 6 is conveyed to the secondary transfer portion T2 is synchronized with the timing at which the recording material P is conveyed to the secondary transfer portion T2.

The secondary transfer portion T2 corresponds to a region (nip portion) between the secondary transfer roller 64 and the opposing roller 63. When a positive DC voltage is applied to the secondary transfer roller 64, a negatively-charged toner image borne by the intermediate transfer belt 6 is secondarily transferred onto the recording material P. The polarity of the toner image is determined based on the toner material. Therefore, the present invention is not limited to an apparatus in which a toner image is negatively charged.

Further, the printer unit B includes a photosensor 12Y configured to measure a measurement image (patch image) formed on the photosensitive drum 1Y, and a photosensor 12M configured to measure a measurement image formed on the photosensitive drum 1M. Further, the printer unit B includes a photosensor 12C configured to measure a measurement image formed on the photosensitive drum 1C, and a photosensor 12K configured to measure a measurement image formed on the photosensitive drum 1K. Each photosensor functions as a measuring unit configured to measure the measurement image.

The image forming apparatus 100 is configured to determine the amount of toner to be supplied to each of the developing devices 4Y, 4M, 4C, and 4K based on the measurement results obtained by the photosensors 12Y, 12M, 12C, and 12K. The printer unit B is not limited to the configuration in which each of the photosensitive drums 1Y, 1M, 1C, and 1K includes the photosensor, and the intermediate transfer belt 6 may include a photosensor.

The image forming portions PY, PM, PC, and PK have the same configuration except that toners of different colors of yellow, magenta, cyan, and black are used in the developing devices 4Y, 4M, 4C, and 4K. In the following description, unless a distinction is particularly required, suffixes Y, M, C, and K given to the reference numerals are omitted.

In the photosensitive drum 1, a photosensitive layer having a negative charging polarity is formed on an outer peripheral surface of an aluminum cylinder. The photosensitive drum 1 is rotationally driven in an arrow R1 direction by a motor (not shown).

The charging device 2 is a scorotron charging device. The charging device 2 is configured to charge the photosensitive drum such that the surface of the photosensitive drum 1 attains a predetermined potential. The charging device 2 is not limited to a scorotron charging device, and may be, for example, a roller charging device.

The exposure device 3 functions as a latent image forming unit configured to expose the photosensitive drum 1 charged by the charging device 2. With this, an electrostatic latent image is formed on the surface of the photosensitive drum 1. The developing device 4 is a developer carrying member configured to rotate while carrying developer (toner). The developing device 4 functions as a developing unit configured to develop the electrostatic latent image formed on the photosensitive drum 1 using toner. With this, a toner image is formed on the photosensitive drum 1.

The primary transfer roller 7 is configured to press the inner surface of the intermediate transfer belt 6 such that a primary transfer portion T1 is formed between the photosensitive drum 1 and the intermediate transfer belt 6. When a positive DC voltage is applied to the primary transfer roller 7, the negative toner image borne on the photosensitive drum 1 is primarily transferred onto the intermediate transfer belt 6 passing through the primary transfer portion T1.

A belt cleaning device 68 is configured to remove toner remaining on the intermediate transfer belt 6 by bringing a cleaning blade into sliding contact with the intermediate transfer belt 6.

The operation unit 20 includes a display 218. The operation unit 20 is connected to a reader image processor 108 of the image reading device A and a controller 110 of the image forming apparatus 100. A user can input printing information including the type of the image and the number of sheets through the operation unit 20.

Now, the image reading device is described. The image reading device A is configured to read an image of an original G placed on an original table glass 102 as illustrated in FIG. 1, and transmit the image data to the printer unit B. The original G is illuminated by a light source 103 so that the image of the original G is formed on a CCD sensor 105 via an optical system 104. The CCD sensor 105 includes a group of CCD line sensors for red (R), green (G), and blue (B), which are arranged in three rows, to thereby generate red, green, and blue color component signals in the respective line sensors. A reading optical system unit including the light source 103, the optical system 104, and the CCD sensor 105 is configured to move in an arrow R103 direction, to thereby convert the image of the original G into an electrical signal data stream for each line.

On the original table glass 102, a baffle 107 to be used by the user to bring the original G into abutment thereagainst is provided. On the original table glass 102, a reference white plate 106 to be used for determining the white level of the CCD sensor 105 is arranged. An image signal obtained by the CCD sensor 105 is subjected to image processing in the reader image processor 108, and is then transmitted to a printer controller 109 to be subjected to image processing.

Figure 2:
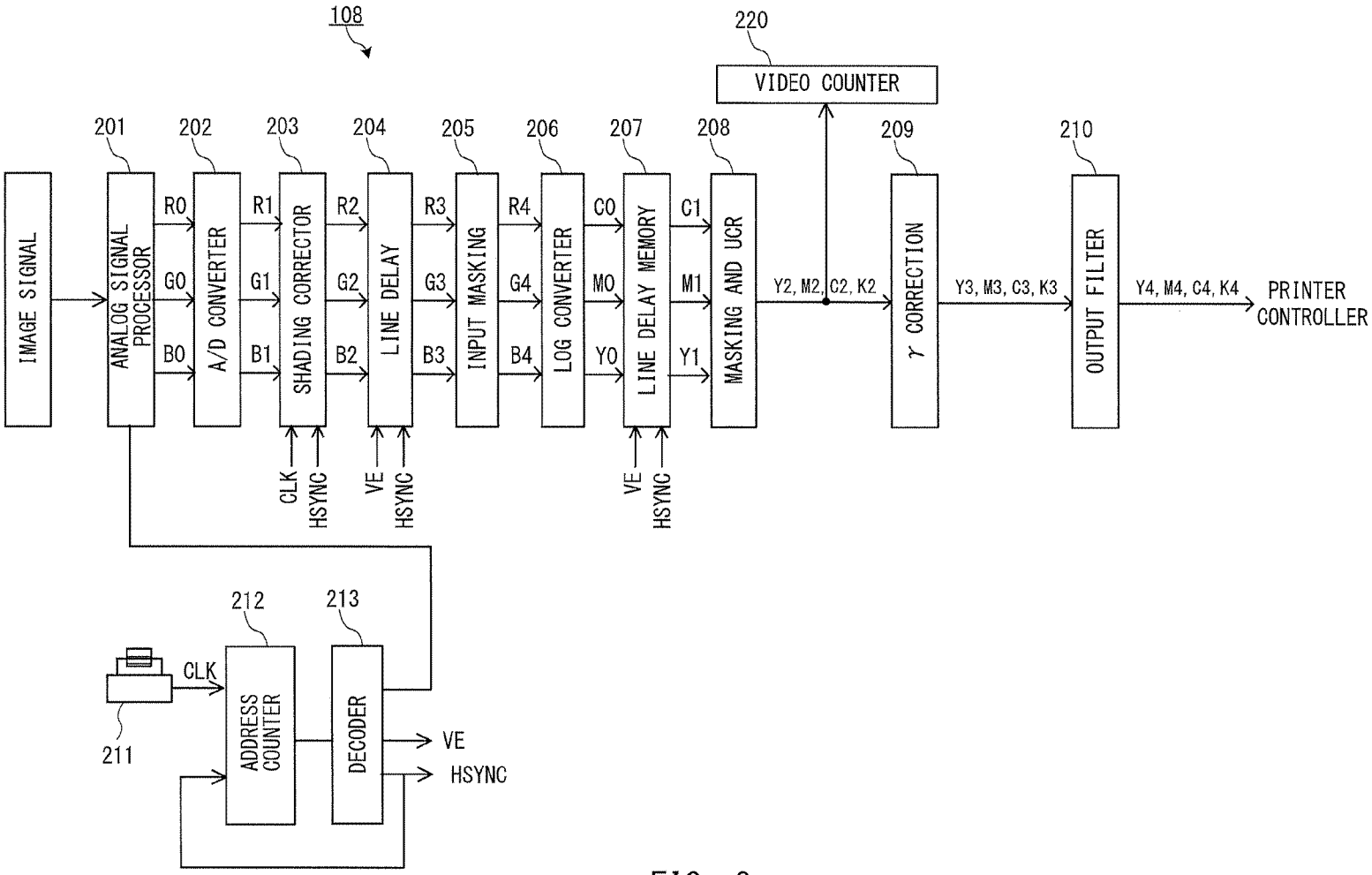
FIG. 2 is a functional block diagram of a reader image processor.

FIG. 2 is a functional block diagram of the reader image processor 108. As illustrated in FIG. 2, a clock generator 211 is configured to generate a clock (CLOCK signal) per pixel unit. An address counter 212 is configured to count the clock of the clock generator 211 to generate a main scanning address for the pixels in each line. The address counter 212 clears the count in response to an HSYNC signal, and starts the counting of the main scanning address for the next one line.

A decoder 213 is configured to decode the main scanning address from the address counter 212, to thereby generate a CCD drive signal per line unit, e.g., a shift pulse or a reset pulse. Further, the decoder 213 is configured to generate a VE signal representing an effective region in an output signal output from the CCD sensor 105, and a line synchronization signal HSYNC.

Figure 3:
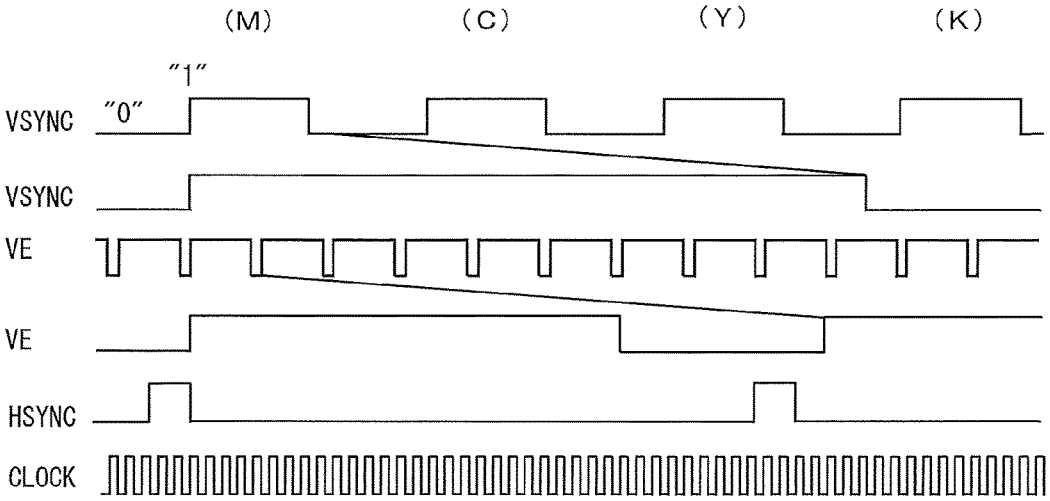
FIG. 3 is a timing chart of each control signal in the reader image processor.

FIG. 3 is a timing chart for illustrating the output timing of each control signal in the reader image processor 108.

As illustrated in FIG. 3, a VSYNC signal is an image effective interval signal in a sub-scanning direction, which is used for image reading (scanning) in an interval of logic "1" to sequentially form output signals of M, C, Y, and K. The VE signal is an image effective interval signal in the main scanning direction, which has the timing of a main scanning start position in the interval of logic "1", and is mainly used for line counting control for line delay. Further, a CLOCK signal is a pixel synchronizing signal, which is used for transfer of image data at rising timing of from "0" to "1".

The image signal output from the CCD sensor 105 is, as illustrated in FIG. 2, input to an analog signal processor 201. The signal input to the analog signal processor 201 is subjected to gain adjustment and offset adjustment here, and is then converted into 8-bit digital image signals R1, G1, and B1 for the respective color signals by an A/D converter 202. The digital image signals R1, G1, and B1 are input to a shading corrector 203, to thereby be subjected to shading correction based on the output signal corresponding to the reference white plate 106.

The respective line sensors of the CCD sensor 105 are arranged with predetermined distances among RGBs, and hence a line delay circuit 204 corrects spatial deviations in the sub-scanning direction among the digital image signals R2, G2, and B2. Specifically, the respective R and G signals are line-delayed in the sub-scanning direction with respect to the B signal, to thereby be adjusted to the B signal.

An input masking unit 205 is configured to convert a reading color space, which is determined based on the spectroscopic characteristics of R, G, and B filters of the CCD sensor 105, into an NTSC standard color space using matrix calculation as follows.

$$\begin{bmatrix} R4 \\ G4 \\ B4 \end{bmatrix} = \begin{bmatrix} a11 & a12 & a13 \\ a21 & a22 & a23 \\ a31 & a32 & a33 \end{bmatrix} \begin{bmatrix} R3 \\ G3 \\ B3 \end{bmatrix}$$

A light amount/image density converter (LOG converter) 206 includes a look-up table (LUT) ROM. The light amount/image density converter (LOG converter) 206 is configured to convert the signal values (R4, G4, and B4) obtained through conversion by the input masking unit 205 into image signals (M0, C0, and Y0) of magenta (M), cyan (C), and yellow (Y).

A line delay memory 207 is configured to delay the timing to transmit the image signals (M0, C0, and Y0) based on a determination signal generated based on the signal values (R4, G4, and B4) obtained through conversion by the input masking unit 205.

A masking and UCR circuit 208 is configured to generate a black (K) signal based on image signals (M1, C1, and Y1) whose timings are changed by the line delay memory 207. Further, the masking and UCR circuit 208 is configured to output signals (M2, C2, Y2, and K2) generated by the masking and UCR circuit 208 to a γ correction circuit 209 and a video counter 220.

The γ correction circuit 209 is configured to convert the image signals so as to correct the gray-scale characteristic of the printer unit B to an ideal gray-scale characteristic in the image reading device A. The γ correction circuit 209 is configured to convert the image signals based on a gray-scale correction table (LUT). For example, when the image forming apparatus 100 forms an image based on image data transmitted from an external device, e.g., a PC or a scanner, the γ correction circuit 209 converts the image signals of the image data based on the gray-scale correction table. A space filter processor (output filter) 210 is configured to perform edge enhancement or smoothing.

Figure 4:
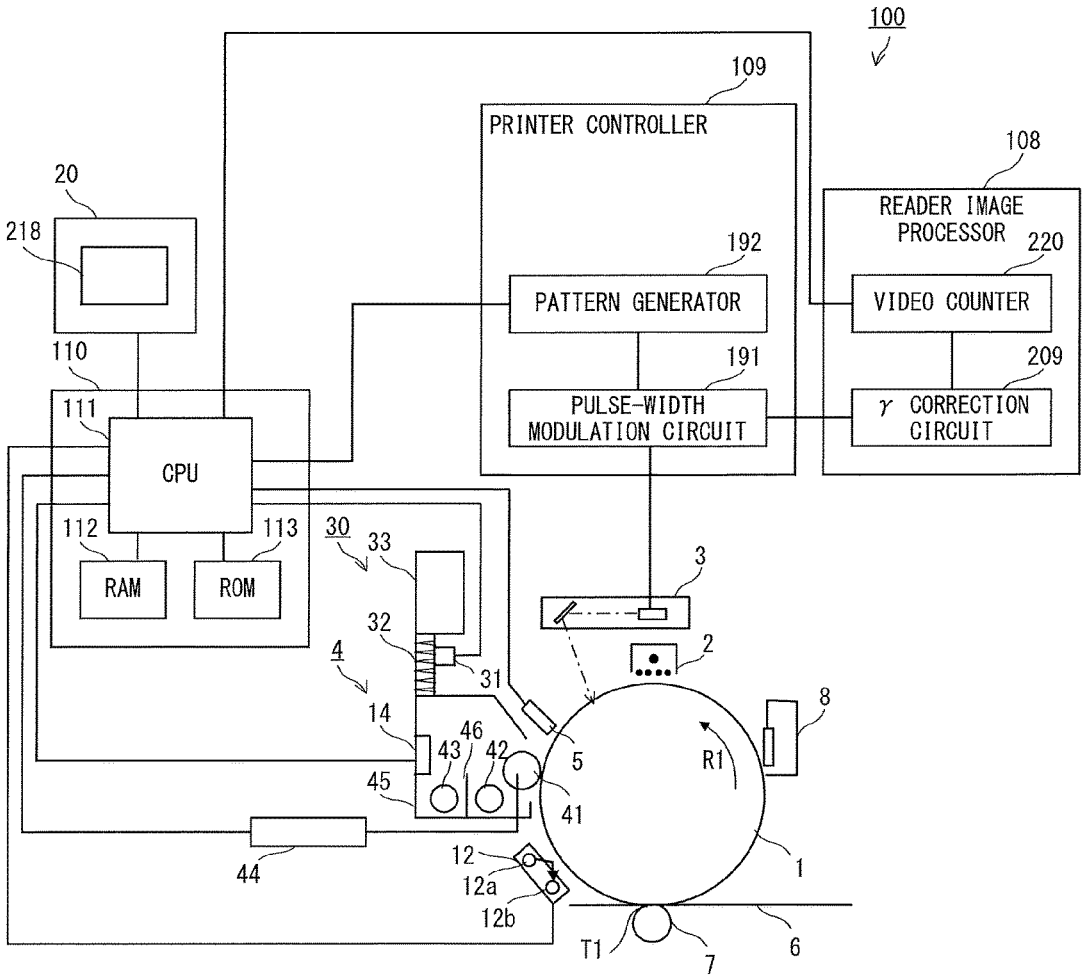
FIG. 4 is a control block diagram of an image forming portion.

Next, the exposure device is described. FIG. 4 is a control block diagram of the image forming apparatus 100. As illustrated in FIG. 4, the image forming apparatus 100 includes the controller 110 configured to comprehensively control an image forming operation. The controller 110 includes a CPU 111, a RAM 112, and a ROM 113. The CPU 111 is a control circuit configured to control each unit of the image forming apparatus 100. The RAM 112 is a system work memory for operation of the CPU 111. The ROM 113 stores a control program necessary for executing various types of processing of a flow chart to be described later. The various types of processing of the flow chart are executed by the CPU 111.

Image signals (M4, C4, Y4, and K4) obtained through processing by the space filter processor 210 illustrated in FIG. 2 are transmitted to the printer controller 109. Then, a pulse-width modulation circuit 191 of the printer controller 109 converts the multivalued image signals (M4, C4, Y4, and K4) into binary signals using pulse-width modulation (PWM). That is, the pulse-width modulation circuit 191 of the printer controller 109 outputs, for each input image signal, a laser drive signal (pulse signal) having a width (time width) corresponding to the level of the image signal.

The binary laser drive signal output from the pulse-width modulation circuit 191 is supplied to a semiconductor laser of the exposure device 3. The semiconductor laser of the exposure device 3 is configured to emit a laser beam for the time corresponding to the pulse width of the laser drive signal. With this, a toner adhering area in a predetermined area of the electrostatic latent image formed on the photosensitive drum 1 is controlled. The image forming apparatus 100 controls the image density (toner adhering amount) through area coverage modulation. That is, a high density region and a low density region included in an image are determined based on the toner adhering area in the predetermined area. As the ratio of the toner adhering area to the predetermined area is increased, the image density is increased.

Next, the developing device is described. The developing device 4 includes a storing unit configured to store developer containing toner (non-magnetic) and carrier (magnetic). In the storing unit, a space in a developing container 45 is divided into a first chamber (developing chamber) and a second chamber (stirring chamber) with a partition wall 46. In the first chamber, a non-magnetic developing roller 41 is arranged, and a magnet is fixed on the inner side of the developing roller 41. A developing motor 44 is configured to rotationally drive the developing roller 41 in a predetermined direction. The developing roller 41 is configured to carry the developer in the first chamber using a magnetic force of the magnet. When the developing roller 41 is rotated, the developer carried by the developing roller 41 is supplied to a developing region formed between the developing roller 41 and the photosensitive drum 1.

In the first chamber, a first screw 42 is arranged. The first screw 42 is configured to stir the developer in the first chamber, and to cause the developer in the first chamber to move in an axial direction of the developing roller 41. In the second chamber, a second screw 43 is arranged. The second screw 43 is configured to stir the developer in the second chamber, and to cause the developer in the second chamber to move in a direction opposite to that of the first screw 42. The second screw 43 is configured to mix the toner supplied from a toner supply tank 33 to the developing container 45 with the developer in the developing container 45.

The partition wall 46 has formed therein holes for communicating between the first chamber and the second chamber. With this, the first screw and the second screw circulate the developer in the developing container 45. The toner is consumed through development, and the developer in the first chamber, which corresponds to the developer in the developing container 45 whose toner concentration is reduced, moves to the second chamber through one developer path. The developer that has been supplied with toner in the second chamber to recover its toner concentration moves into the first chamber through another developer path.

The developing device 4 includes a blade. Toner passing between the developing roller 41 and the blade is supplied to the developing region. That is, the blade functions as a regulating member configured regulate the amount of the developer carried by the developing roller 41.

The developing roller 41 is applied with a developing bias voltage (oscillation voltage) obtained by superimposing an AC voltage onto a negative DC voltage Vdc by a developing bias power source (not shown). With this, the negatively charged toner is transferred onto an electrostatic latent image on the photosensitive drum 1, which is shifted to a positive polarity relative to the developing roller 41, to thereby reversely develop the electrostatic latent image.

A developer supply device 30 includes the toner supply tank 33 storing toner for supply, which is arranged above the developing device 4. Below the toner supply tank 33, a toner conveyance screw 32 to be rotationally driven by a motor 31 is installed.

The toner conveyance screw 32 is configured to supply the toner for supplying to the developing device 4 through a toner conveyance path in which the toner conveyance screw 32 is arranged. The toner supply by the toner conveyance screw 32 is controlled through control of rotation of the motor 31 by the CPU 111 of the controller 110 via a motor drive circuit (not shown). The RAM 112 connected to the CPU 111 stores control data or the like to be supplied to the motor drive circuit. The toner supply tank 33, the motor 31, the toner conveyance screw 32, and the like construct the developer supply device 30. As described above, the developer supply device 30 functions as a supplying unit configured to supply toner to the storing unit.

The developing device 4 includes an inductance sensor 14 configured to output a signal corresponding to the magnetic permeability of developer containing magnetic carrier and non-magnetic toner. That is, the output value of the inductance sensor 14 varies based on the toner ratio (toner concentration) in the developer in the developing device 4. The controller 110 can detect the amount of toner in the developing device 4 based on the output value of the inductance sensor 14. The inductance sensor 14 and the controller 110 function as a detector configured to detect the amount of toner stored in the storing unit.

In the developing device storing the two-component developer, in general, the charge amount of the toner particles changes depending on the mixing ratio of the toner particles to the carrier particles in the developing device. When the ratio of the toner particles in the developer decreases, the charge amount of the toner particles increases. When the charge amount of the toner particles increases, the amount of toner particles that adhere to the electrostatic latent image controlled to have a predetermined potential decreases to cause decrease in image density. On the other hand, when the ratio of the toner particles in the developer increases, the charge amount of the toner particles decreases. When the charge amount of the toner particles decreases, the amount of toner particles that adhere to the electrostatic latent image controlled to have a predetermined potential increases to cause increase in image density.

The controller 110 is configured to convert the output value of the inductance sensor 14 into a toner concentration T/D of the developer in the developing device 4 using Expression 1.

$$T/D=\{(SGNL\ \text{value})-(SGNLi\ \text{value})\}/\text{Rate}+(\text{Initial}\ T/D) \quad \text{(Expression 1)}$$

In Expression 1, SGNL value represents an output value of the inductance sensor 14, SGNLi value represents an initial measurement value (initial value) of the inductance sensor 14, and Rate represents the sensitivity of the inductance sensor 14. Initial T/D and SGNLi value use predetermined values, and Rate is a value obtained based on the result of measuring the sensitivity to T/D of ΔSGNL in advance as the characteristic of the inductance sensor 14. Those constants (Initial T/D, SGNLi value, and Rate) are stored in advance in the RAM 112 of the controller 110.

Next, toner supply is described. Along with formation of an image by the image forming apparatus 100, the amount of toner in the developing device 4 decreases. Therefore, the controller 110 executes toner supply control to supply toner from the toner supply tank 33 to the developing device 4. The amount of toner to be supplied from the toner supply tank 33 to the developing device 4 is determined such that the charge amount of the toner particles in the developing device 4 is brought to a target charge amount. That is, when the charge amount of the toner particles is higher than the target charge amount, the controller 110 increases the toner supply amount, and when the charge amount of the toner particles is lower than the target charge amount, the controller 110 decreases the toner supply amount.

Therefore, the controller 110 is configured to determine the toner supply amount based on the amount of toner consumed in the developing device 4, and to correct the determined toner supply amount based on the charge amount of the toner particles in the developing device 4. As described above, the image forming condition is controlled based on the conditions for determining the toner charge amount (determination conditions). The determination conditions are updated based on the result of measuring the measurement image.

That is, the controller 110 (first controller) determines a basic supply amount Mv based on the image signal. Then, the controller 110 determines a supply correction amount Mp based on the result of detecting the measurement image (patch image), and determines the amount of toner to be supplied to the developing device 4 (toner supply amount Msum) based on the basic supply amount Mv and the supply correction amount Mp (Expression 2).

$$(\text{Toner supply amount } Msum) = Mv + \{Mp/(\text{Cycle of forming patch images})\} \quad \text{(Expression 2)}$$

The basic supply amount Mv is determined based on the image signal read by the image reading device A, or on the image signal input from an external device.

The video counter 220 determines a value (video count value) corresponding to the amount of toner to be consumed in the developing device 4 when an image for one page is formed based on the image signals (M2, C2, Y2, and K2) output by the masking and UCR circuit 208.

For example, when a 128-level half-tone image is formed to have a resolution of 600 dpi and an A3 full-size (16.5 inch×11.7 inch), the video count value is "128×600×600×16.5×11.7=8,895,744,000".

The video count value is converted into the basic supply amount My using a table representing the relationship between the video count value and the toner supply amount, which is obtained in advance and stored in the ROM 113.

Figure 5:
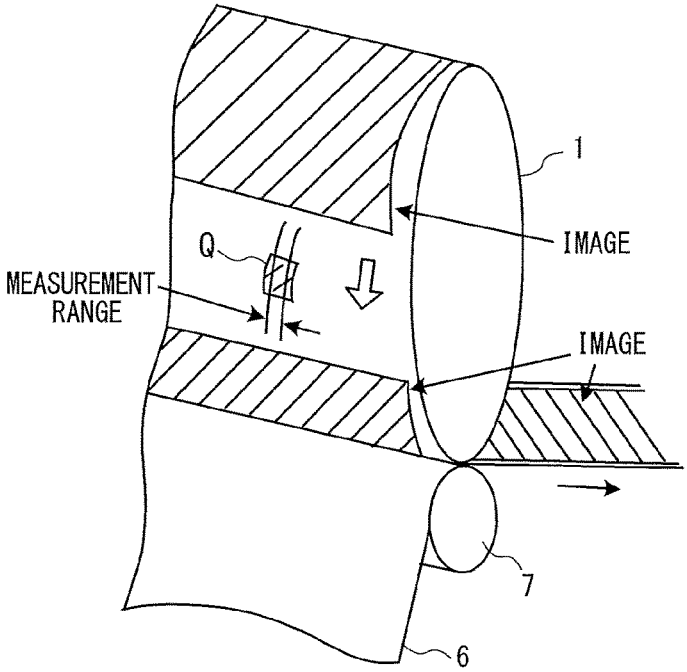
FIG. 5 is a schematic view of a patch image formed on a photosensitive drum.
Figure 6:
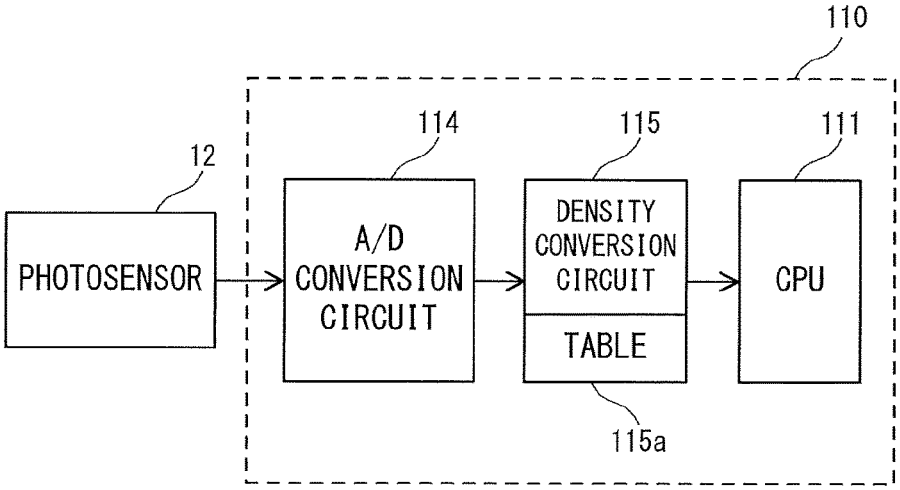
FIG. 6 is a schematic diagram for illustrating a relationship between a controller of the image forming apparatus and a photosensor.
Figure 7:
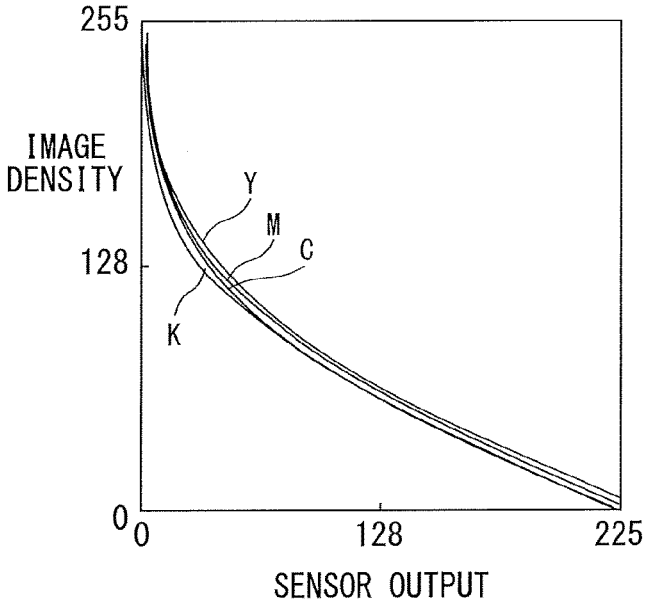
FIG. 7 is an explanatory graph of a relationship between image density and photosensor output.

FIG. 5 is a schematic view of the patch image. FIG. 6 is a schematic diagram for illustrating the relationship between the controller 110 and the photosensor 12. FIG. 7 is an explanatory graph of the relationship between the image density and the photosensor output. Description is given also with reference to FIG. 4.

The controller 110 causes the image forming portion P to form a patch image Q each time the printer unit B forms images for n pages. The patch image Q is formed in a region between an image of an n-th page and an image of an (n+1)th page of the photosensitive drum 1.

Then, the controller 110 causes the photosensor 12 to detect the patch image Q, and determines the supply correction amount Mp such that the image density of the patch image Q is brought to the target density based on the result of detecting the patch image Q.

The printer controller 109 includes a pattern generator 192 configured to generate a patch image signal having a signal level corresponding to the image density determined in advance. The pattern generator 192 supplies the patch image signal to the pulse-width modulation circuit 191 for generation of a laser drive signal having a pulse width corresponding to the above-mentioned density determined in advance.

The printer controller 109 supplies the laser drive signal to the semiconductor laser of the exposure device 3 to cause the semiconductor laser to emit light for the time corresponding to the pulse width. The laser beam emitted from the semiconductor laser is deflected by a polygon mirror to scan the photosensitive drum 1. With this, an electrostatic latent image corresponding to the patch image Q is formed on the photosensitive drum 1. This patch electrostatic latent image is developed by the developing device 4.

On the downstream side of the developing device 4, the photosensor 12 configured to detect the patch image Q is arranged so as to be opposed to the photosensitive drum 1.

The photosensor 12 includes a light emitting portion 12*a* including a light emitting element, e.g., an LED, and a light receiving portion 12*b* including a light receiving element, e.g., a photodiode (PD). The light emitting portion 12*a* radiates light to the photosensitive drum 1. The patch image Q formed on the photosensitive drum 1 reflects the light of the light emitting portion 12*a*. The light receiving portion 12*b* receives light reflected from the patch image Q to output a signal based on the received light intensity (received light amount).

The reflected light (near-infrared light) from the photosensitive drum 1, which is input to the photosensor 12, is converted into an electrical signal. An analog electrical signal of from 0 V to 5 V is converted into an 8-bit digital signal by an A/D conversion circuit 114 included in the controller 110. Then, this digital signal is converted into density information by a density conversion circuit 115 included in the controller 110.

The density conversion circuit 115 is configured to convert the signal output from the photosensor 12 into the density of the patch image Q. Alternatively, the density conversion circuit 115 may be configured to convert the signal output from the photosensor 12 into an amount of toner adhering to the patch image Q.

As shown in FIG. 7, when the image density of the patch image Q formed on the photosensitive drum 1 is gradually changed through area coverage modulation, the output of the photosensor 12 changes depending on the density of the formed patch image. The output value of the photosensor 12 corresponding to the result of detecting a low-density patch image is higher than the output value of the photosensor 12 corresponding to the result of detecting a high-density patch image. In this case, the output of the photosensor 12 under a state in which the toner is not adhering to the photosensitive drum 1 is 5 V. When the output of the photosensor 12 is 5 V, the A/D conversion circuit 114 outputs a 255-level signal to the CPU 111.

As the area coverage of the toner in the pixel formed on the photosensitive drum 1 is increased, thereby increasing the image density, the output of the photosensor 12 is decreased. Based on such a characteristic of the photosensor 12, a table 115*a* dedicated for each color is prepared in advance so as to convert the output of the photosensor 12 into a density signal for each color. The table 115*a* is stored in, for example, a storage unit of the density conversion circuit 115. With this, the density conversion circuit 115 can read the density of the patch image with high accuracy for each color. The density conversion circuit 115 outputs the density information to the CPU 111.

As described above, the CPU 111 of the controller 110 derives the toner supply amount Msum based on Expression 2. Further, the CPU 111 controls the motor 31 to rotate the toner conveyance screw 32, to thereby supply toner with the toner supply amount Msum from the toner supply tank 33 to the developing container 45.

The image forming apparatus 100 negatively charges the photosensitive drum, and negatively charges the toner particles, to thereby cause the toner particles to adhere to a part subjected to light radiation (light portion). The photosensitive drum is charged using the charging roller so as to maintain a constant potential, and hence the potential of the light portion at which the toner is developed is changed depending on the intensity of the light radiated from the LD. That is, the amount of toner adhering to the electrostatic latent image formed on the photosensitive drum (on the photosensitive member) can be adjusted by controlling the amount of light radiated to the photosensitive drum.

The CPU 111 predicts the toner charge amount based on the toner consumption amount, the supply amount, and the toner amount in the developing container. The CPU 111 predicts the charge amount of the toner particles every predetermined times based on the following calculation expressions. Under a state in which the developing roller is rotated, the CPU 111 determines the charge amount of the toner particles based on Expression 4. This case is referred to as a first determination condition.

Meanwhile, under a state in which the developing roller is not rotated, the CPU 111 determines the charge amount of the toner particles based on Expression 5. This case is referred to as a second determination condition.

A. During Rotation of Developing Roller:

$$TCA=(\alpha-TCP\}\times CTS/\beta+(STC\times SA-TCP\times CA)/TAC+TCA \quad \text{(Expression 4)}$$

(TCA: Toner charge amount
TCP: toner charge amount at previous calculation
CTS: calculation time step
STC: supply toner charge amount
SA: supply amount
CA: consumption amount
TAC: toner amount in developing container)

B. During Stop of Developing Roller:

$$TCA=TCP\times(1-\gamma) \quad \text{(Expression 5)}$$

In the expressions, coefficients α, β, and γ are values determined in advance based on the toner charging characteristic. The coefficient α represents a saturation charge amount of the toner particles, the coefficient β represents a time speed at which frictional charging (charge elimination) is performed, and the coefficient γ represents a time speed of charge amount leakage from the toner particles. The coefficient β is larger than 1. The coefficient γ is larger than 0 and smaller than 1. Supply toner charge amount is also determined in advance.

Expression 4 is described. On the right side of Expression 4, the amount (first term) of increase of the charge amount of the toner particles due to the frictional charging and the charge amount (second term) of the toner particles in the developing device, which has been changed due to discharge of toner particles from the developing device and supply of new toner particles to the developing device, are added to the previous toner charge amount (third term). That is, the current toner charge amount is predicted by adding, to the previous toner charge amount, the change amount so far from the calculation of the previous toner charge.

Under a state in which the developing roller is not rotated, the toner particles in the developing device release charges. Expression 5 is a calculation expression representing that the charge amount of the toner particles in the developing device decays at a predetermined time constant.

Expression 4 and Expression 5 are calculation expressions for predicting the toner charge amount with high accuracy in a standard environment (temperature and humidity) determined in advance. However, the environment of the place at which the image forming apparatus is installed may be different from the standard environment. Therefore, in the present invention, the image forming apparatus 100 is configured to form the measurement image at a predetermined timing, to thereby correct (update) the calculation expressions based on the result of measuring the measurement image by the photosensor. Now, description is given of a method of updating the first determination condition and the second determination condition based on the rotation time of the developer carrying member and on the result of measuring the measurement image, that is, a method of correcting (updating) the calculation expressions. The determination conditions are updated mainly by the CPU 111 functioning as an updating unit. Further, the CPU 111 functions as a first updating unit configured to update the first determination condition based on the result of measuring the measurement image, and a second updating unit configured to update the second determination condition based on the result of measuring the measurement image.

Figure 13:
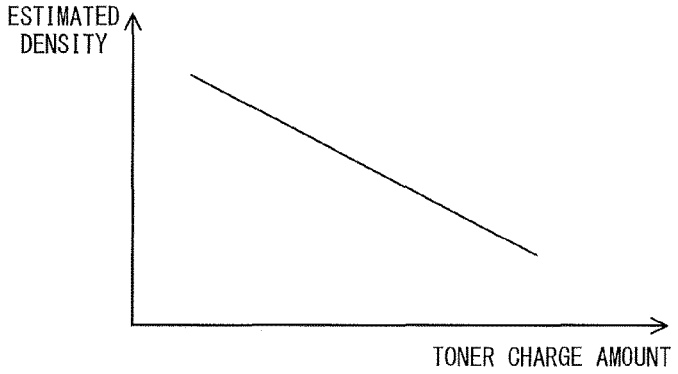
FIG. 13 is a graph for showing a relationship between the toner charge amount and density.

The CPU 111 forms the measurement image (patch image) on the photosensitive drum 1, and causes the photosensor 12 to measure the patch image. Then, the CPU 111 determines a measurement result (patch density) Dp of the patch image. Further, the CPU 111 predicts the toner charge amount when the patch image is formed, and predicts the result of measuring the patch image based on the toner charge amount. The measurement result predicted by the CPU 111 is referred to as an estimated density Ds. The density of the patch image (amount of toner adhering to the patch image) is significantly dependent on the toner charge amount. Therefore, the CPU 111 can obtain the estimated density Ds based on the toner charge amount. FIG. 13 is a graph for showing the relationship between the toner charge amount and the estimated density Ds.

The CPU 111 calculates a difference ΔD between the actually measured value Dp and the predicted value Ds based on Expression 6.

$$\Delta D=Dp-Ds \quad \text{(Expression 6)}$$

When the non-rotation state of the developing roller is continued for a predetermined time period, for example, 8 hours or more, the CPU 111 corrects (updates) the coefficient γ based on the difference ΔD.

On the other hand, when the non-rotation state of the developing roller is continued for less than 8 hours, the CPU 111 corrects (updates) the coefficient β based on the difference ΔD. The correspondence relationship between the non-rotation time period of the developing roller and the coefficient to be corrected is shown in Table 1.

TABLE 1

| Non-rotation time period of developing roller | Model correction |
|---|---|
| 8 hours or more | γ correction |
| less than 8 hours | β correction |

After a predetermined time period elapses from the printing end or the end of operation input by the user, the image forming apparatus 100 automatically switches the mode of the image forming apparatus from a normal mode to a power saving mode (also called energy saving mode or sleep mode, for example). When the mode is switched from the normal mode to the power saving mode, the image forming apparatus can reduce the power consumption during standby. When the mode of the image forming apparatus 100 is switched from the power saving mode to the normal mode, the CPU 111 acquires the non-rotation time period of the developing roller.

After the mode of the image forming apparatus 100 is switched from the power saving mode to the normal mode, the CPU 111 rotates the developing roller. Then, the CPU 111 causes the image forming portion to form the patch image on the photosensitive drum 1, and executes correction processing of correcting the coefficients β and γ based on the result of measuring the patch image by the photosensor. The non-rotation time period of the developing roller can be measured by the CPU 111 grasping the drive state of the developing motor 44 via a counter (not shown), for example. Alternatively, instead of the non-rotation time period of the developing roller, a time period from when the mode is switched from the normal mode to the power saving mode last time to when the mode is switched from the power saving mode to the normal mode again may be used.

The toner charge amount decays depending on the time in which the toner particles are left unstirred as indicated by the solid line in an interval of from 0 and 1 of FIG. 12 to be described later. The influence of this decay is started to be reflected on the patch density when the toner particles are left for about 8 hours, and hence the update threshold is set to 8 hours.

The CPU 111 changes the correction amount of γ or β based on the difference ΔD. When the patch density Dp is higher than the estimated density Ds, the CPU 111 determines that the toner charge amount is smaller than an estimated charge amount. On the other hand, when the patch density Dp is lower than the estimated density Ds, the CPU 111 determines that the toner charge amount is larger than the estimated charge amount.

Figure 8:
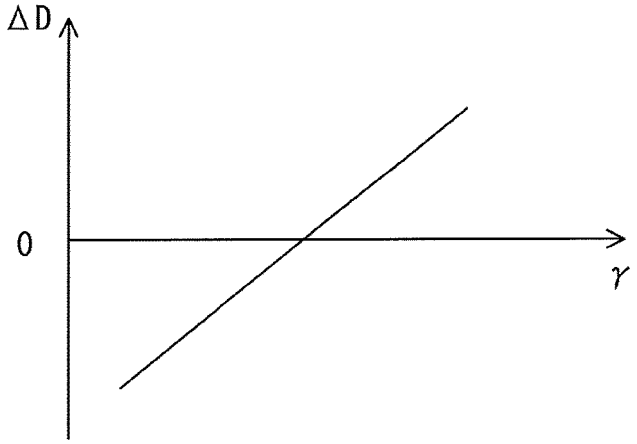
FIG. 8 is a relationship graph of $\Delta D$ and $\gamma$ when a developing roller is not rotated for 8 hours or more.
Figure 9:
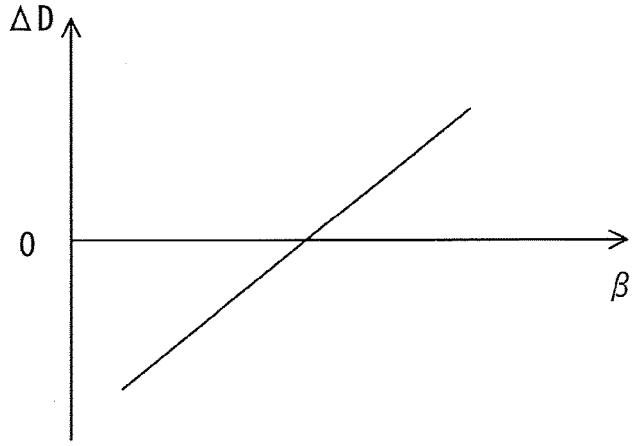
FIG. 9 is a relationship graph of $\Delta D$ and $\beta$ when the developing roller is rotated for less than 8 hours.

FIG. 8 is a graph for showing the relationship between the difference ΔD and the coefficient γ when the non-rotation time period of the developing roller is 8 hours or more. FIG. 9 is a graph for showing the relationship between the difference ΔD and the coefficient β when the non-rotation time period of the developing roller is less than 8 hours.

Figure 10:
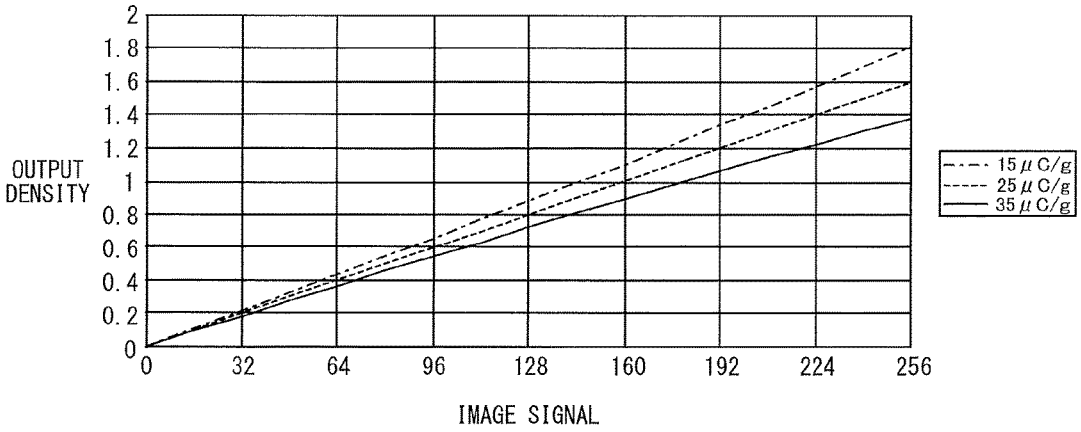
FIG. 10 is a relationship graph of a change in toner charge amount and change to each density region.

Next, the relationship between the change in toner charge amount and the change to each density region is shown in FIG. 10. As is understood from FIG. 10, there is a tendency that the density is lower as the toner charge amount is higher. The density is reduced in each density region substantially at a proportional relationship, but there is a tendency that a high density region is susceptible to the effect of the toner charge amount, and a low density region is insusceptible to the effect of the toner charge amount. The toner charge amount is represented as an average of the entire toner in the developing device 4.

Figure 11:
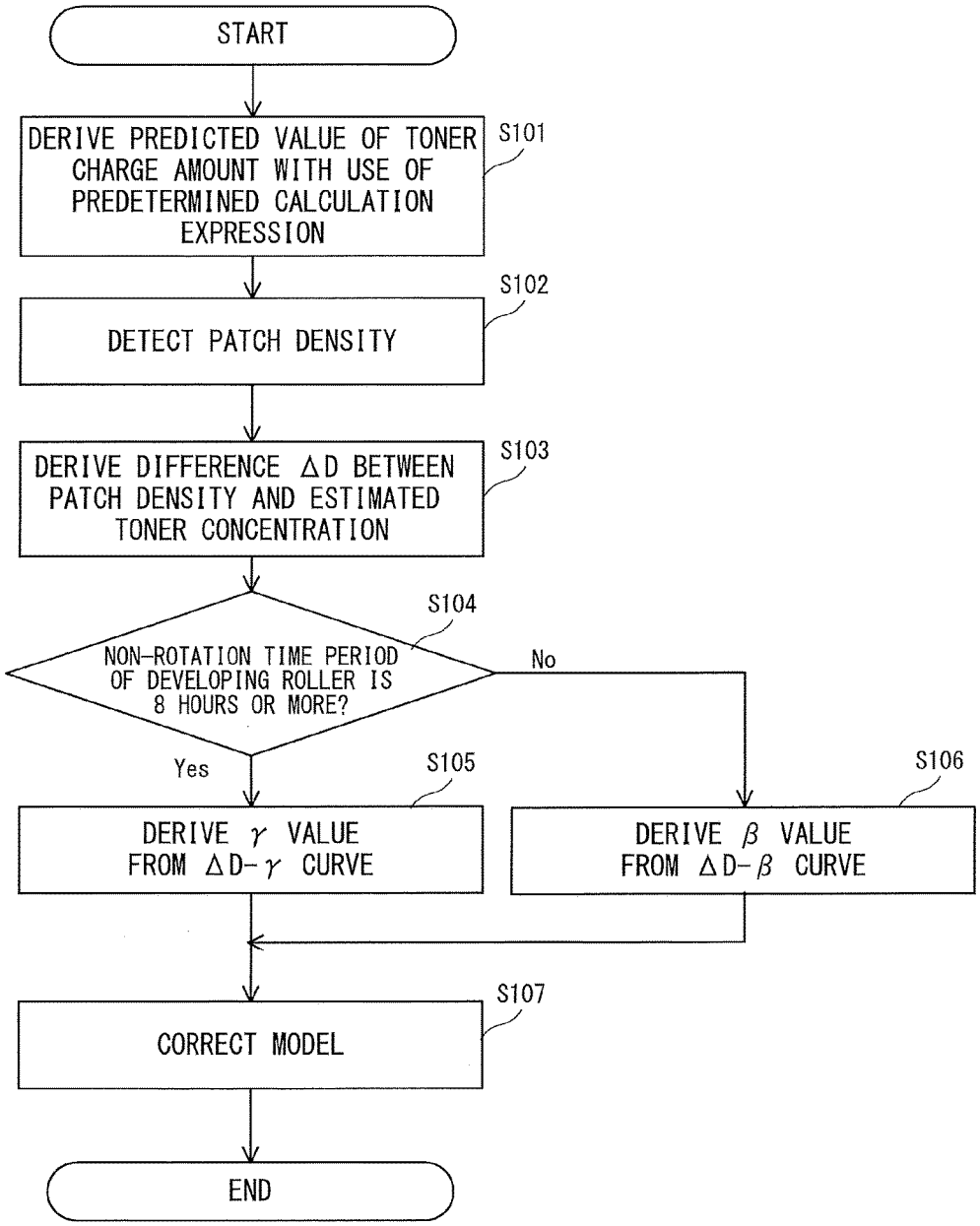
FIG. 11 is a flowchart for illustrating an example of a control processing procedure of the image forming apparatus.

FIG. 11 is a flowchart for illustrating an example of a control processing procedure of the image forming apparatus 100. Each step of processing illustrated in FIG. 11 is mainly executed by the CPU 111 of the controller 110.

The CPU 111 derives the predicted value of the toner charge amount based on a predetermined calculation expression (Step S101). The CPU 111 forms the patch image at the above-mentioned predetermined potential, and then verifies the patch image to acquire the patch density Dp (Step S102).

The CPU 111 derives the difference ΔD between the patch density Dp and the toner concentration Ds estimated based on the predicted value of the toner charge amount (Step S103).

The CPU 111 determines whether or not the non-rotation time period of the developing roller is 8 hours or more (Step S104). When the non-rotation time period of the developing roller is 8 hours or more (Step S104: Yes), the CPU 111 derives the γ value from a ΔD−γ curve (Step S105) to correct (update) the model (prediction expression for the toner charge amount) (Step S107). Further, when the non-rotation time period of the developing roller is less than 8 hours (Step S104: No), the CPU 111 derives the β value from a ΔD−β curve (Step S106) to update the model (prediction expression for the toner charge amount) (Step S107).

Figure 12:
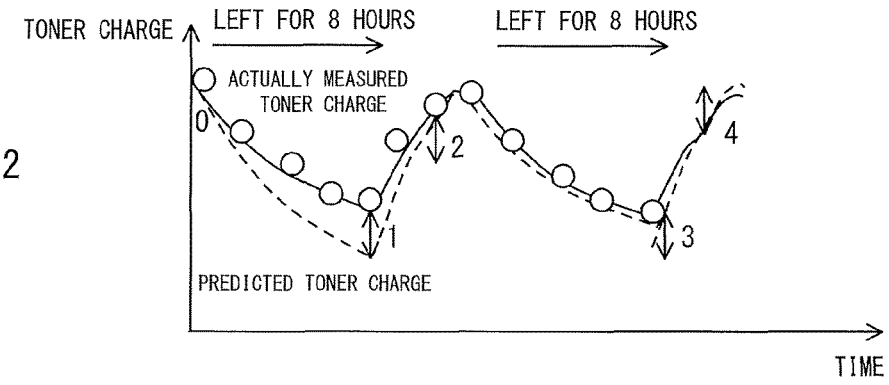
FIG. 12 is a graph for showing an effect obtained by a method of updating a prediction expression for the toner charge amount.

FIG. 12 is a graph for showing an effect obtained by the method of updating the prediction expression for the toner charge amount. That is, in FIG. 12, there are shown results of transition of the toner charge amount when the prediction expression for the toner charge amount is appropriately corrected (updated) based on the patch result depending on the length of the non-rotation time period of the developing roller. The actually measured toner charge amount is indicated by the circle mark, and an approximate line is indicated by the solid line. Further, the predicted toner charge amount is indicated by the dotted line. The operation state in each period of from 0 to 1, from 1 to 2, from 2 to 3, and from 3 to 4 in FIG. 12 is as follows.

From 0 to 1: The developing roller is not rotated for 8 hours.

From 1 to 2: 1,000 A4-size sheets each having an image with an image ratio of 5% are continuously fed.

From 2 to 3: The developing roller is not rotated for 8 hours.

From 3 to 4: 1,000 A4-size sheets each having an image with an image ratio of 5% are continuously fed.

At the time point of 0 in FIG. 12, there was no difference between the predicted toner charge amount and the actually measured toner charge amount. However, during the period from 0 to 1, while the developing roller was in a non-rotation state for 8 hours, as the time elapsed, the actually measured toner charge amount was gradually deviated from the predicted toner charge amount. This occurs because the γ value is not appropriate.

At the time point of 1 in FIG. 12, the main body is activated, and the patch image is verified. At this time, the difference was ΔD=0.1. Then, the γ value was set to 0.05 based on the ΔD−γ curve. During the period from 1 to 2, while the developing roller is rotated, the toner charge amount is recovered to reach 2 in FIG. 12. During this period, patch verification is performed at 24-sheet intervals to correct the β value. Therefore, such an effect that the difference between the actually measured toner charge amount and the predicted toner charge amount is reduced to be small during the period from 1 to 2 can be observed. Then, during the period from 2 to 3, the developing roller was not rotated for 8 hours again.

However, the increase in a difference between the actually measured toner charge amount and the predicted toner charge amount, which occurred in the period from 0 to 1, did not occur. The reason for this is considered to be that the γ value was able to be appropriately corrected at the time point of 1 in FIG. 12. Then, when the developing roller is rotated during the period from 3 to 4 again, the β value is appropriately corrected, and hence the difference between the actually measured toner charge amount and the predicted toner charge amount is reduced from that during the period from 1 to 2.

When the model (prediction expression) is not updated in this embodiment, the difference in toner charge amount was about 12. This means that color variation ΔE is about 6. With this embodiment, at the time point of 4 in FIG. 12, the difference in toner charge amount was about 8. This provides an effect of suppressing the color variation ΔE to about 4. The above-mentioned effect is attained as a result of performing an appropriate update based on the non-rotation time period of the developing roller.

According to the present invention, the image forming condition can be controlled based on the toner charge amount. Therefore, the number of test patterns can be decreased, and the downtime required during the processing of adjusting the image forming condition can be decreased. Further, according to the present invention, the prediction expression suitable for the environment is generated based on the toner concentration Ds estimated from the predicted value of the toner charge amount and on the result of measuring the patch image. Therefore, the density of the output image and the color of the output image can be controlled with high accuracy even when the environment changes.

Now, description is given of another example having a feature in that β (time speed at which frictional charging (charge elimination) is performed) and γ (time speed of charge amount leakage from toner particles) are continuously updated for each non-rotation time period of the developing roller.

In the above-mentioned image forming apparatus, the method of updating the prediction expression is switched depending on whether or not the non-rotation time period of the developing roller is 8 hours or more. As described above, the method is uniformly switched based on whether the non-rotation time period of the developing roller is shorter or longer than hours. Hence, the different methods of updating the expression are applied to the case where the developing roller stopping state is continued for, for example, 7 hours and 59 minutes and the case of 8 hours, although the reductions of the toner charge amount are equivalent to each other. That is, discontinuity in terms of classification may occur. In the following description, there is described as an example a case where, in order not to cause the discontinuity, the update of β and γ is continuously changed.

With this, it is possible to respond to cases of various non-rotation time periods of the developing roller without causing any discontinuity. In the following description, a timer having a higher resolution is used. Further, functions and configurations similar to those described above are denoted by like reference symbols, and description thereof is omitted.

In Table 2, the correction rates of γ and β depending on the non-rotation time period of the developing roller are shown.

TABLE 2

| Non-rotation time period of developing roller | Model correction | |
|---|---|---|
| | γ correction rate | β correction rate |
| Less than 1 hour | 0 | 100 |
| 1 hour or more | 10 | 90 |
| 2 hours or more | 20 | 80 |
| 3 hours or more | 50 | 50 |
| 4 hours or more | 60 | 40 |
| 5 hours or more | 70 | 30 |
| 6 hours or more | 80 | 20 |
| 7 hours or more | 90 | 10 |
| 8 hours or more | 100 | 0 |

The CPU 111 calculates ΔDγ=ΔD×(γ correction rate) and ΔDβ=ΔD×(β correction rate) based on the correction rates of γ and β.

According to this image forming apparatus, the correction rates of the expressions are gradually and continuously changed depending on the non-rotation time period of the developing roller, and hence the calculation expressions can be appropriately updated. This effect is described with reference to FIG. 14.

Figure 14:
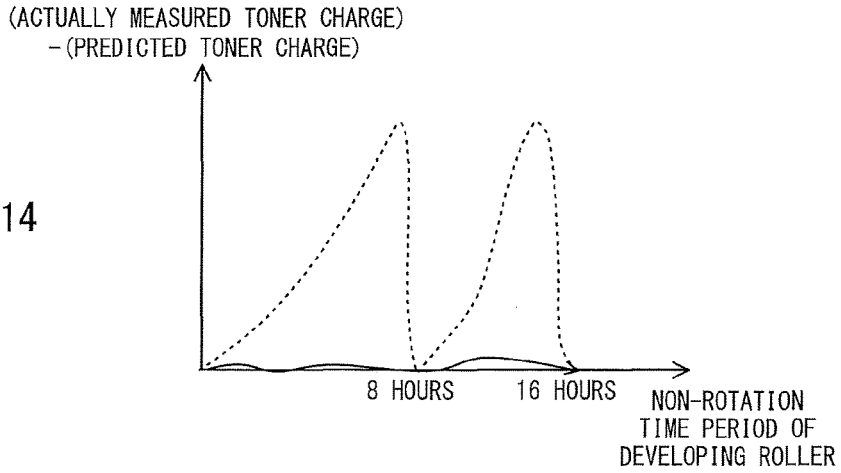
FIG. 14 is a graph for showing an effect obtained by another method of updating a prediction expression for the toner charge amount.

FIG. 14 is a graph for showing the effect obtained by another method of updating the prediction expression for the toner charge amount.

The dotted line of FIG. 14 indicates the transition of the toner charge amount when the prediction expression is not corrected, and the solid line indicates the transition of the toner charge amount when the prediction expression is corrected. The vertical axis of FIG. 14 represents the absolute value of the difference between the actually measured toner charge amount and the predicted toner charge amount, and the lateral axis of FIG. 14 represents the non-rotation time period of the developing roller.

When the prediction expression is not corrected, the prediction accuracy varies depending on whether the non-rotation time period of the developing roller is less than 8 hours or 8 hours or more. However, correction of the prediction expression enables reduction of the difference (prediction error). Specifically, when the prediction expression was not corrected, the difference (prediction error) was about 10 at the maximum. This causes a density deviation corresponding to ΔE=5 in the color variation index.

On the other hand, when the prediction expression was corrected, this difference (prediction error) was reduced to about 6 at the maximum. This causes a density deviation corresponding to ΔE=3 in the color variation index. That is, the performance of the image forming apparatus is increased by 40%. In this manner, the toner charge amount can be correctly predicted, and the density and the color of the output image can be controlled with high accuracy.

As described above, according to the present invention, even when the environment changes, the image density can be controlled with high accuracy.

The embodiments described above are presented in order to specifically describe the present invention, and the scope of the present invention is not limited to those exemplary embodiments. Further, the control in each of the embodiments is achieved by, for example, a micro-processing unit (MPU), an application specific integrated circuit (ASIC), a system-on-a-chip (SoC), and others.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-020768, filed Feb. 5, 2016, which is hereby incorporated by reference herein in its entirety.

What is claimed is:

1. An image forming apparatus, comprising:

a photosensitive member;

a latent image forming unit configured to form an electrostatic latent image on the photosensitive member;

a developing unit configured to contain developer including toner, and to develop the electrostatic latent image on the photosensitive member using the developer;

a detector configured to detect an amount of the toner in the developing unit;

a supplying unit configured to supply toner to the developing unit;

a sensor configured to measure a measurement image; and a controller configured:

to determine a charge amount of the toner in the developing unit based on a determination condition, an amount of the toner consumed in the developing unit, an amount of the toner supplied by the supplying unit, and the amount of the toner detected by the detector, and to control an image forming condition based on the determined charge amount, wherein the developing unit comprises a developer carrying member configured to rotate while carrying the developer, wherein the determination condition comprises:

a first determination condition for determining the charge amount under a state in which the developer carrying member is rotated, and a second determination condition for determining the charge amount under a state in which the developer carrying member is not rotated, wherein the controller updates the first determination condition and the second determination condition based on a rotation time period of the developer carrying member and a measurement result by the sensor, wherein the controller is further configured:

to update the first determination condition based on the measurement result of the measurement image when the rotation time period of the developer carrying member is shorter than a predetermined time period, and to update the second determination condition based on the measurement result of the measurement image in a case where the rotation time period of the developer carrying member is longer than the predetermined time period.

2. An image forming apparatus, comprising:

a photosensitive member, an exposure unit configured to expose the photosensitive member to form an electrostatic latent image on the photosensitive member;

a developing unit configured to develop the electrostatic latent image on the photosensitive member using a developer, the developing unit including a rotation member;

a transfer portion at which the image is transferred onto a sheet;

a detector configured to detect developer contained in the developing unit;

a sensor configured to measure a measurement image developed by the developing unit;

a controller configured to:

control an image forming condition based on:

a determination condition which includes a first determination condition and a second determination condition, and a detection result of the detector, form the measurement image by the photosensitive member, the exposure unit and the developing unit, and measure the measurement image by the sensor to generate the determination condition, wherein, in a case where a non-rotation period of the rotation member during a predetermined time period is a first period, the controller generates the first determination condition based on:

the density of the measurement image which is obtained from the detection result of the detector based on the determination condition, and a measurement result of the measurement image, the predetermined time period being a period from a time at which the measurement image is previously formed to a time at which the measurement image is currently formed, and wherein, in a case where the non-rotation period of the rotation member during the predetermined time period is a second period longer than the first period, the controller generates the second determination condition based on:

the density of the measurement image which is obtained from the detection result of the detector based on the determination condition, and the measurement result of the measurement image.

3. The image forming apparatus according to claim 2, wherein the controller determines statistic data from the detection result of the detector based on the determination condition, and controls the image forming condition based on the determined statistic data.

4. The image forming apparatus according to claim 2, wherein the rotation member is configured to rotate to stir the developer contained in the developing unit, the controller determines a charge amount of the toner from the detection result of the detector based on the determination condition, the first determination condition is used to determine the charge amount during a time period in which the rotation member is rotating, and the second determination condition is used to determine the charge amount during a time period in which the rotation member is not rotating.

5. The image forming apparatus according to claim 2, wherein the controller is configured to form the measurement image in a case where the image forming apparatus is switched from a normal mode to a power saving mode.

6. The image forming apparatus according to claim 2, wherein the first period is shorter than a predetermined time, and the second period is longer than the predetermined time.

7. The image forming apparatus according to claim 2, wherein the sensor measures the measurement image on the photosensitive member.

8. The image forming apparatus according to claim 2, wherein the image forming apparatus further comprises an intermediate transfer member to which the image on the photosensitive member is transferred, and wherein the sensor measures the measurement image on the intermediate transfer member.

* * * * *